US008577564B2

(12) United States Patent
Stanek

(10) Patent No.: US 8,577,564 B2
(45) Date of Patent: Nov. 5, 2013

(54) SYSTEM AND METHOD FOR CONTROLLING MOVEMENT ALONG A THREE DIMENSIONAL PATH

(75) Inventor: Daniel Stanek, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 131 days.

(21) Appl. No.: 13/335,413

(22) Filed: Dec. 22, 2011

(65) Prior Publication Data

US 2013/0166156 A1 Jun. 27, 2013

(51) Int. Cl.
*G06F 7/70* (2006.01)

(52) U.S. Cl.
USPC ..... 701/50

(58) Field of Classification Search
USPC ..... 701/50
See application file for complete search history.

(56) References Cited

U.S. PATENT DOCUMENTS

| | | | | |
|---|---|---|---|---|
| 4,910,673 | A | 3/1990 | Narisawa et al. | |
| 5,257,177 | A | 10/1993 | Back et al. | |
| 5,908,458 | A | 6/1999 | Rowe et al. | |
| 5,918,527 | A | 7/1999 | Haga et al. | |
| 6,363,632 | B1 | 4/2002 | Stentz et al. | |
| 6,968,264 | B2 | 11/2005 | Cripps | |
| 2006/0212172 | A1 * | 9/2006 | Jarrott | 700/262 |
| 2010/0250073 | A1 * | 9/2010 | McCabe et al. | 701/50 |

OTHER PUBLICATIONS

Coulter, "Implementation of the pure pursuit path tracking algorithm," Tech. Report CMU-RI-TR-92-01, Robotics Institute, Carnegie Mellon University (Jan. 1992).

* cited by examiner

*Primary Examiner* — Hussein A. Elchanti
(74) *Attorney, Agent, or Firm* — Leydig, Voit & Mayer

(57) ABSTRACT

A system for automated movement of a reference point along a three dimensional path stores a three dimensional path including a plurality of spaced apart points. A velocity vector of the reference point and a look ahead vector extending from the reference point define a plane of travel. A directional vector of the reference point is determined along the plane of travel, and a command vector directs movement of the reference point at least in part based upon the directional vector. The velocity vector and the look ahead vector may be used to determine the directional vector. A method is also provided.

20 Claims, 7 Drawing Sheets

SYSTEM AND METHOD FOR CONTROLLING MOVEMENT ALONG A THREE DIMENSIONAL PATH

TECHNICAL FIELD

This disclosure relates generally to automated movement of a component and, more particularly, to a system and method for controlling and optimizing automated movement of a work tool or component along a three dimensional path.

BACKGROUND

Automated or autonomous movement of mechanisms and machines is increasingly desirable for many operations including those related to earthmoving and other industrial activities. Automated machines remain consistently productive without regard to a human operator or environmental conditions. In addition, automated or autonomous systems may permit operation in environments that are unsuitable or undesirable for a human operator. Such automated or autonomous systems may also compensate for inexperienced human operators as well as inefficiencies associated with repetitive tasks.

A system is known that generates a path for automated movement of a machine along a two dimensional path. Such system operates by determining a desired target and calculating a new velocity based upon the current velocity of the machine and the desired target. The process is repeated and, as the machine moves, a new path is generated so as to create a plurality of velocity vectors that define a path of movement along the two dimensional path.

Automated or autonomous movement along a three dimensional path creates additional complexities and thus systems incorporating such movement are typically limited in their operation. U.S. Pat. No. 6,968,264 discloses a system for controlling a mechanical arm of a machine. A controller operates to determine the most suitable path from an existing database. The controller then defines the velocity commands needed to follow the chosen path, and adds a correction velocity command based upon positional error to maintain the arm along the path. Movement of the arm, however, is limited to pre-defined paths.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for automated movement of a component along a three dimensional path is provided. The system includes a movable component having a reference point and a controller configured to store a three dimensional path. The controller is further configured to determine a velocity vector extending generally from a position of the reference point generally in a direction of movement of the reference point and to determine a look ahead vector extending generally from the position of the reference point generally towards a look ahead point. The look ahead point is located generally along the three dimensional path. The controller also is configured to determine a plane of travel on which the velocity vector and the look ahead vector lie, to determine a directional vector of the reference point along the plane of travel, and to determine a command vector directing movement of the reference point at least in part based upon the directional vector.

In another aspect, a system for automated movement of a component along a three dimensional path is provided. The system includes a movable component having a reference point and a controller configured to store a three dimensional path. The controller is further configured to determine a plane of travel generally along which movement of the reference point is desired and to determine a velocity vector extending from a position of the reference point generally in a direction of movement of the reference point. The controller is further configured to determine a look ahead vector extending generally from the position of the reference point generally towards a look ahead point with the look ahead point being located generally along the three dimensional path and scale the velocity vector and the look ahead vector to define a scaled velocity vector and a scaled look ahead vector. The scaled velocity vector and the scaled look ahead vector have identical magnitudes. The controller is also configured to determine a directional vector of the reference point along the plane of travel based upon the scaled velocity vector and the scaled look ahead vector, and to determine a command vector directing movement of the reference point at least in part based upon the directional vector.

In another aspect, a method of moving a component along a three dimensional path in an automated manner is provided. The method includes providing a movable component having a reference point and storing a three dimensional path. A velocity vector extending generally from a position of the reference point generally in a direction of movement of the reference point is determined. A look ahead vector extending generally from the position of the reference point towards a look ahead point is determined. The look ahead point is located generally along the three dimensional path. A plane of travel on which the velocity vector and the look ahead vector lie is determined. A directional vector of the reference point along the plane of travel is determined and a command vector directing movement of the reference point is determined at least in part based upon the directional vector.

DETAILED DESCRIPTION

Figure 1:
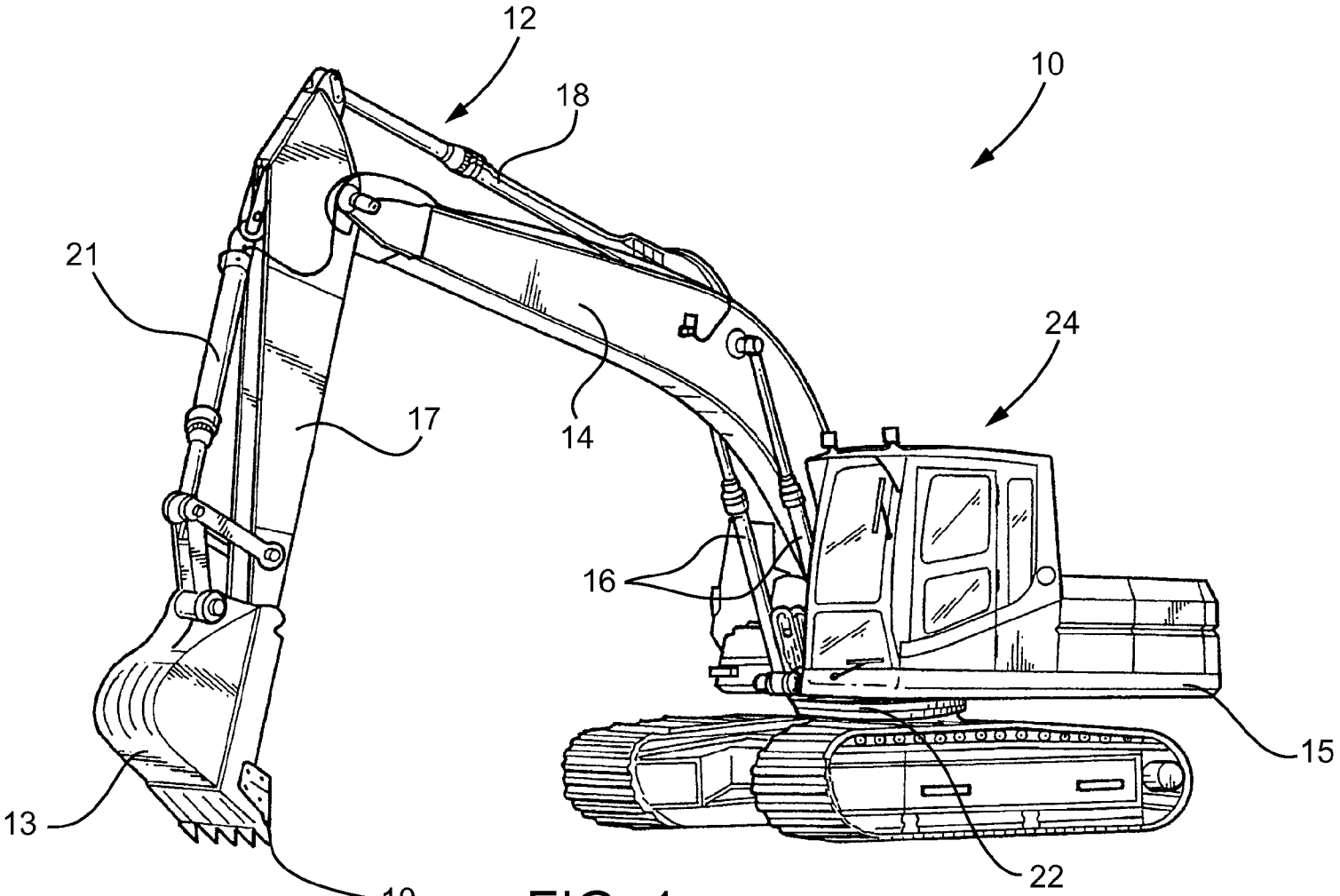
FIG. 1 is a side view of an excavator that may incorporate the concepts disclosed herein.

FIG. 1 illustrates an exemplary machine 10 having multiple systems and components that cooperate to perform various tasks such as excavating and loading earthen material onto a nearby target machine such as a haul vehicle (not shown). In one example, machine 10 may embody a hydraulic excavator. It is contemplated, however, that machine 10 may embody other types of machines having an implement system 12 for moving a movable component or work tool 13 along a three-dimensional path between a first position such as a dig location and a second position such as a dump location.

Figure 2:
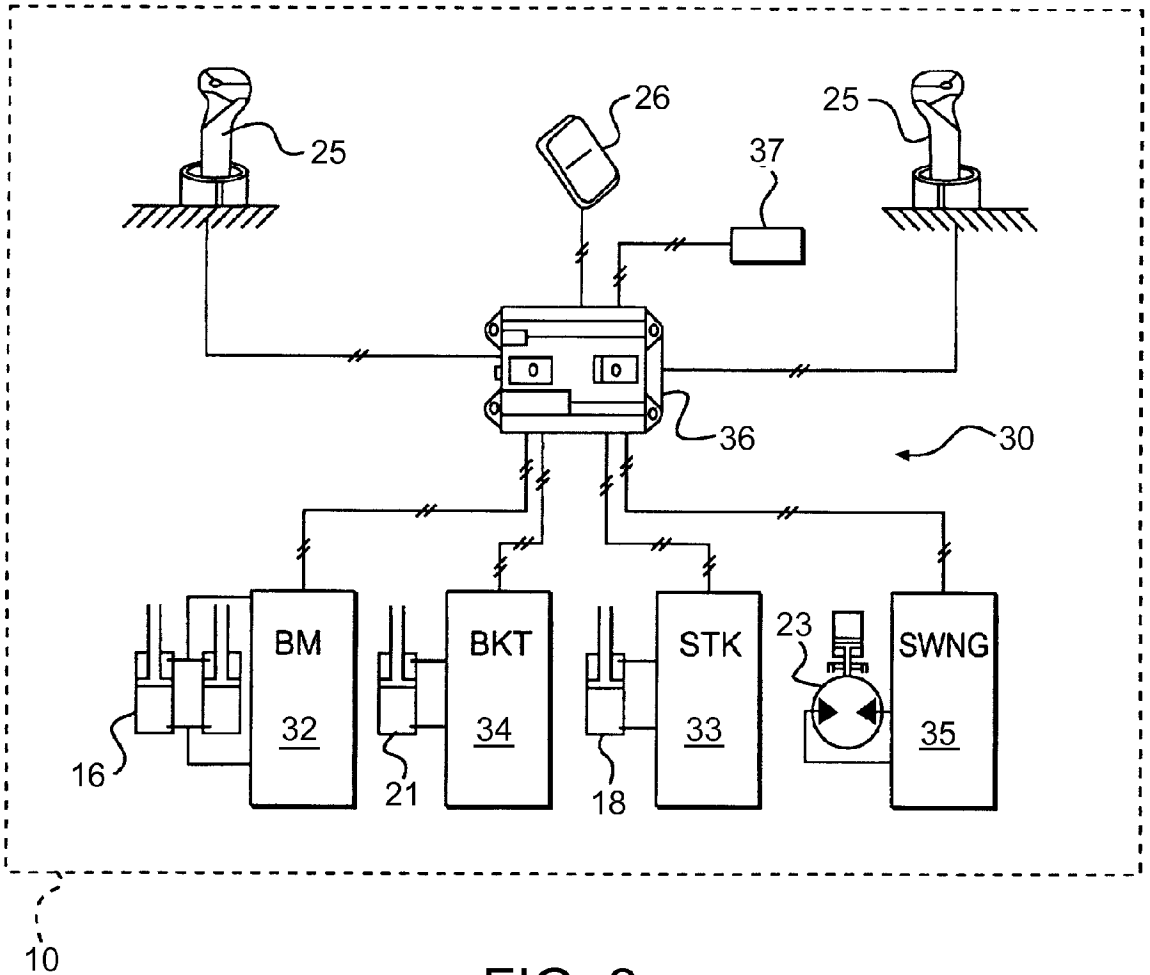
FIG. 2 is a simplified schematic of control components of a control system within the excavator of FIG. 1.

Implement system 12 may include a linkage structure utilizing fluid actuators to move work tool 13. More specifically, implement system 12 may include a boom member 14 vertically pivotal relative to frame 15 and propelled by a pair of adjacent, double-acting, boom hydraulic cylinders 16. Implement system 12 may also include a stick member 17 vertically pivotal about a horizontal axis through boom member 14 and stick member 17 and propelled by a single, double-acting, stick hydraulic cylinder 18. Implement system 12 may further include a single, double-acting, work tool hydraulic cylinder 21 operatively connected to work tool 13 to pivot work tool 13 vertically about a horizontal axis through stick member 17 and work tool 13. Frame 15 may be horizontally pivotally connected relative to an undercarriage member 22, and moved about vertical axis by a swing motor 23 (FIG. 2). It is contemplated that a different number of fluid actuators may be included within implement system 12 and connected in a manner other than described above, if desired.

Numerous different work tools 13 may be attachable to machine 10 and controllable through an operator station 24. In addition to the bucket depicted in FIG. 1, work tool 13 may include any device used to perform a particular task such as, for example, a fork arrangement, a blade, a shovel, a hammer, an electro-magnet, or any other task-performing device known in the art. Although connected in the embodiment of FIG. 1 to pivot and swing relative to machine 10, work tool 13 may alternatively or additionally rotate, slide or move in any other manner known in the art.

Operator station 24 may include one or more operator input devices such as single or multi-axis joysticks 25 (FIG. 2) as well as operator input devices 26 known in the art such as wheels, knobs, push-pull devices, switches, and pedals. As illustrated in FIG. 2, machine 10 includes a control system 30 to control the hydraulic cylinders and swing motor together with other fluid components that cooperate to move work tool 13. In particular, control system 30 may include one or more fluid circuits (not shown) configured to produce and distribute streams of pressurized fluid. A boom control valve 32, a stick control valve 33, a bucket control valve 34 and a swing control valve 35 may be situated to receive pressurized fluid and selectively meter the fluid to and from hydraulic cylinders and swing motor, respectively, to regulate the motions thereof.

Control system 30 may also include a controller 36 in communication with operator input devices 26 and the control valves to coordinate the movements described above. The controller 36 may be an electronic controller that operates in a logical fashion to perform operations, execute control algorithms, store and retrieve data and other desired operations. The controller 36 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller such as power supply circuitry, signal conditioning circuitry, driver circuitry, and other types of circuitry.

The controller 36 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 36 may be implemented in hardware and/or software without regard to the functionality.

The controller 36 may rely on one or more maps relating the input device position signal, desired actuator speed or force, associated flow rates and pressures, and/or valve element positions associated with movement of the hydraulic cylinders and swing motor may be stored in the memory of controller 36. Each of these maps may include a collection of data in the form of tables, graphs, and/or equations. In one example, desired speed and commanded flow rate may form the coordinate axis of a two dimensional table for controlling the first and second chamber supply and drain elements described above. The commanded flow rate required to move the fluid actuators at the desired speed and the corresponding valve element position of the appropriate supply and drain elements may be related in another separate two dimensional map or together with desired speed in a single three dimensional map. It is also contemplated that desired actuator speed may be directly related to the valve element position in a single two dimensional map. Controller 36 may be configured to allow the operator of machine 10 to directly modify these maps and/or to select specific maps from available relationship maps stored in the memory of controller 36 to affect fluid actuator motion. It is contemplated that the maps may additionally or alternatively be automatically selectable based on modes of machine operation, if desired.

Control system 30 may be equipped with one or more sensors 37 for monitoring the position and velocity of the various components of machine 10. In one example, the sensors 37 may be position sensors associated with each of hydraulic cylinders to determine the amount of displacement of each cylinder. In another example, the sensors 37 may be angle sensors associated with the pivot joints of implement system 12. In another example, the sensors 37 may be inclinometers and/or gyroscopes. The sensors 37 may also include tilt sensors configured to detect a pitch and a roll of frame 15 and may include sensors for determining the position and orientation of the machine relative to a local or global reference such as by using, for example, a local laser system or one or more global position system ("GPS") sensors. In some instances, a pair of GPS sensors may be used. In other instances, a single GPS sensor may be used to determine global position together with a compass to determine orientation. In addition, the sensors 37 may include elements capable of determining velocity or angular velocity as well as load sensors configured to detect a payload of work tool 13 (i.e., a mass of material contained within and transported by work tool 13). The combination of sensors may be chosen as desired for the particular needs and applications of machine 10.

Based on signals generated from the sensors and based on known kinematics of machine 10, controller 36 is configured to command the control valves to move or position the work tool 13 at the speeds and/or forces desired by the operator. In addition, based on the signals generated by the sensors, controller 36 may be able to derive and record some or all of the positions, velocities, accelerations, orientations, masses, and/or inertias of implement system 12.

Machine 10 and control system 30 may be configured to include a system for automated or autonomous movement of the work tool 13 so as to perform various tasks in an automated manner. In one example, a work tool 13 may be moved along a three dimensional path to perform a desired task. The three dimensional path may be defined by or include a plurality of points along the path.

Figure 3:
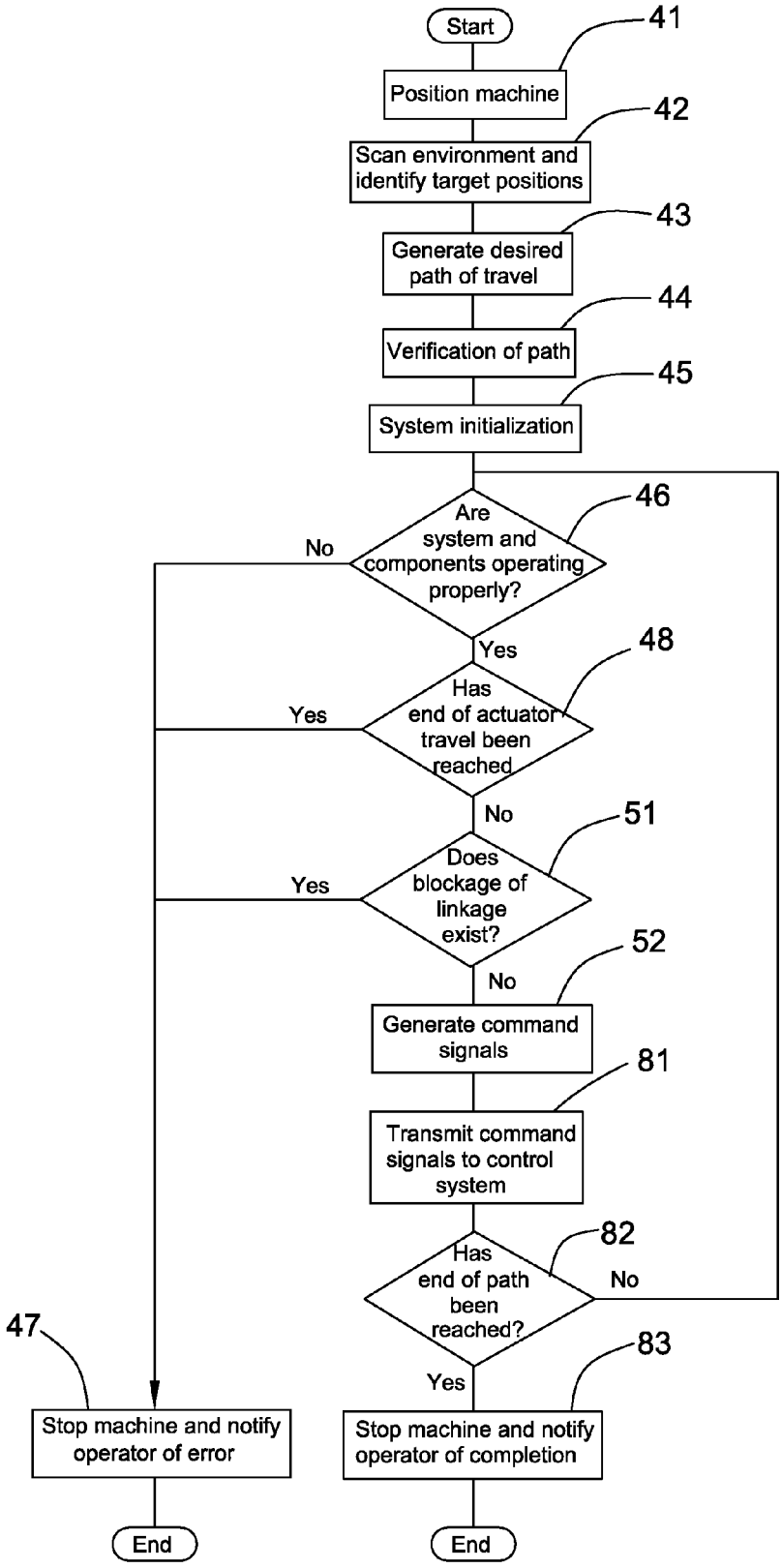
FIG. 3 is a flowchart illustrating a process for automated control of a component along a three dimensional path.

Referring to FIG. 3, a flowchart depicting a process for automated movement of a work tool 13 along a three dimensional path is depicted. At stage 41, a machine 10 is positioned at a desired location. At stage 42, the environment at which the machine 10 is located is analyzed and the environment is scanned and the ground and targets of an automated operation are identified. A physical map or model of the environment including a map of the terrain, the work material to be acted upon, the location of the machine 10, and the location of any target vehicle may be established. In addition, areas in which additional work is to be performed may be identified. For example, if some areas will require additional operations while other areas require fewer operations, this information may be input into the system which may result in the generation of additional path points spaced along the path or may result in the work tool 13 moving more slowly in certain areas along the path.

Figure 5:
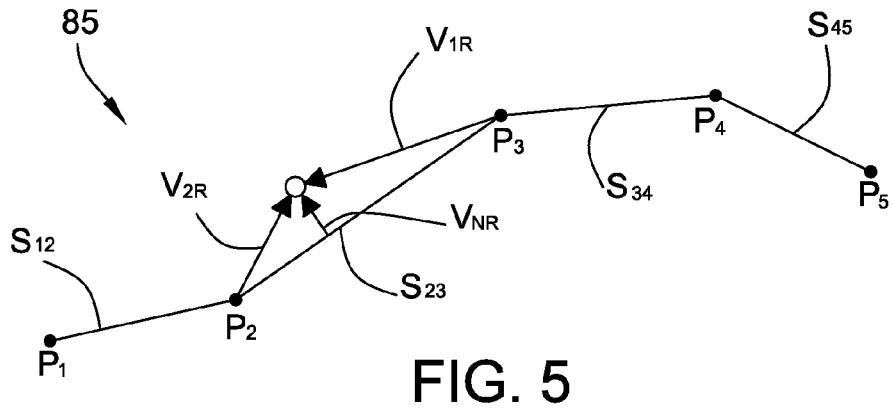
FIG. 5 is a diagrammatic illustration of a portion of a path of travel of a reference point of the component along a three dimensional path.

Referring to FIG. 5, a simplified example of a portion of a three dimensional path 85, such as a path along which work took 13 may be moved, is depicted. Three dimensional path 85 may be divided into a plurality of path points that are numbered for purposes of providing examples herein. As such, the three dimensional path 85 is depicted as having a first point $P_1$, a second point $P_2$, a third point $P_3$, etc. Each line between a pair of points may be referred to herein as a segment with numbers designating the end points such as segment $S_{12}$ extending between first point $P_1$ and second point $P_2$.

Referring back to FIG. 3, a three dimensional path 85 of travel of the work tool 13 is generated at stage 43. The three dimensional path 85 may be the path of a specific point or reference point 19 on the work tool 13. In one example, the reference point 19 may be the end of a particular tooth of an excavator bucket (FIG. 1). In other examples, the reference point 19 may be the tip of a hammer, the center of an electromagnet, or any other location on or associated with the work tool 13. The path may be generated by planning software that generally optimizes the movement of the reference point 19. The three dimensional path 85 may be defined as a series of distinct, spaced apart points that may be evenly spaced apart along the path or have an uneven distance between the points. The three dimensional path including the plurality of spaced apart points along the path may be stored within controller 36. Once the operating environment has been scanned and the desired three dimensional path 85 generated, the control system 30 may include a display (not shown) on which an operator may view a model or simulation of the operation of the machine 10 as the reference point 19 moves along three dimensional path 85. If the operator approves of the model or simulation, the operator may provide an approval signal with an operator input device 26 (FIG. 2) so that the control system begins automated operation at stage 44. Upon such approval, the control system 30 may run diagnostic schemes and search for various initialization codes at stage 45.

Once the system has been initialized, the system may also conduct various tests to confirm that the system and components of machine 10 are operating properly at decision stage 46. If any of the system or components of machine 10 are not operating properly, the controller 36 may stop the machine 10 and notify the operator of an error at stage 47.

If the system and components of machine 10 are operating properly at decision stage 46, the controller may determine whether any of the hydraulic cylinders or actuators have reached their end of travel positions at decision stage 48. If any of the actuators have reached their end travel positions, movement of the work tool 13 may be limited or prevented so that reference point 19 will no longer be able to move along three dimensional path 85. In such case, the controller 36 may stop the machine 10 at stage 47 and notify the operator of an error.

If none of the actuators have reached their end of travel positions, the controller 36 may determine at decision stage 51 whether the linkage structure is in danger of colliding with the machine 10 or another obstacle so as to create a blockage of the linkage. If the controller 36 determines that the any components of the linkage structure are in danger of colliding with the machine 10 or another obstacle, the controller 36 may stop the machine at stage 47 and notify the operator of an error. If no collision or blockage is likely to occur, the controller 36 may generate command signals at stage 52 to direct the various components of the linkage assembly and thus work tool 13 along a desired path so that the reference point 19 moves along three dimensional path 85.

Figure 4:
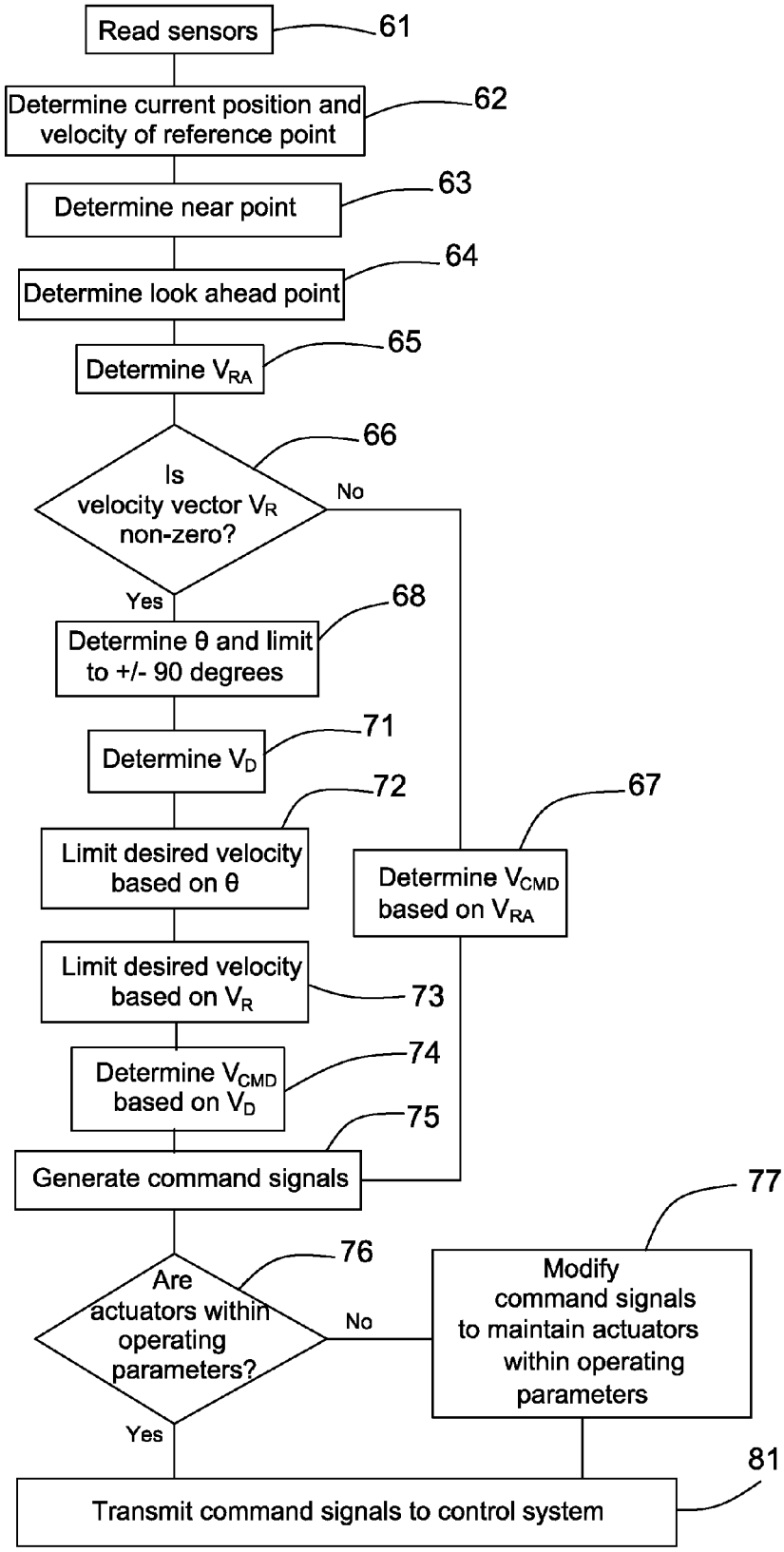
FIG. 4 is a flowchart illustrating a further aspect of the automated control process of FIG. 3.

Referring to FIG. 4, a flowchart depicting the details of the generation of the command signals at stage 52 is depicted. More specifically, the flowchart depicts the process for repeatedly determining the direction of movement and speed of reference point 19 so as to move the reference point 19 along a generally smooth three dimensional path. In doing so, the reference point 19 may generally follow the three dimensional path 85 but will likely, at times, vary from such path. The control system 30 set forth herein is configured to monitor the position of the reference point 19 at a predetermined sample rate frequency and generate command signals to move the reference point generally along the three dimensional path 85. More specifically, the control system 30 determines a desired velocity vector or positional vector $V_D$ (i.e., direction and speed) of the reference point 19 based upon its current velocity vector $V_R$, its position relative to the three dimensional path 85, and a target or look ahead point 89 a predetermined distance ahead along the path. The control system 30 repeats the process so as to move the reference point 19, and thus work tool 13, along the three dimensional path 85 in a relatively smooth and efficient manner.

At stage 61, the sensors on machine 10 including those associated with the implement system 12 such as work tool 13, boom member 14, and stick member 17 and movement of frame 15 relative to undercarriage member 22 are monitored or read and the data provided to controller 36. By using the data from the sensors, the controller 36 may determine at stage 62 the current position and the velocity of the reference point 19 on the work tool 13. The current position and velocity of the reference point 19 may be determined using kinematic equations based upon the data from the sensors and in view of the dimensions, positions and movement of the components of the machine 10 and implement system 12. The velocity of the reference point 19 is indicated as velocity vector $V_R$ in FIG. 10 extending generally from a position of the reference point 19 in a direction of movement of the reference point and being tangent to the circle 93.

Figure 7:
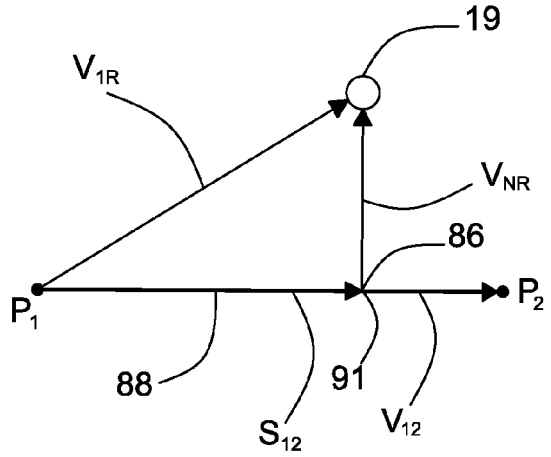
FIG. 7 is a diagrammatic illustration of a portion of the path of travel relative to the reference point.

At stage 63, the controller determines the closest point or near point 86 on three dimensional path 85 to the reference point 19 of the work tool 13. To do so, the distance from the reference point 19 to each segment along the three dimensional path 85 is determined. The calculation to determine the distance from the reference point 19 to each segment is repeated for each segment. To calculate the shortest distance between the reference point 19 and three dimensional path 85, the distance between each segment of the path and the reference point 19 is determined. As shown in FIG. 7, the segment $S_{12}$ between point $P_1$ and $P_2$ may be expressed as a vector $V_{12}$. The path between the point $P_1$ and the reference point 19 may be expressed as a second vector $V_{1R}$. The projection 88 of vector $V_{1R}$ onto vector $V_{12}$ may be used to determine the shortest distance between reference point 19 and the segment $S_{12}$. The projection 88 of vector $V_{1R}$ onto vector $V_{12}$ may be determined by using a dot product or scalar product function of the vector $V_{1R}$ and the vector $V_{12}$.

Figure 8:
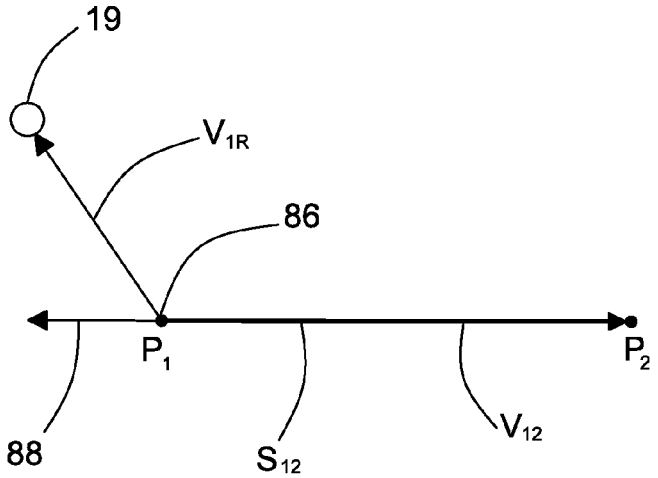
FIG. 8 is a diagrammatic illustration of a different portion of the path of travel relative to the reference point.

Based upon the results of the dot product, the vector from the near point 86 on the three dimensional path 85 to the reference point 19 may be determined in three different manners. If the dot product is negative, the projection 88 of vector $V_{1R}$ is along a line through vector $V_{12}$ but before the first point $P_1$ as depicted in FIG. 8. As a result, the closest or near point 86 along segment $S_{12}$ to reference point 19 is first point $P_1$ and the shortest path from segment $S_{12}$ extends from point $P_1$ and is equal to vector $V_{1R}$.

Figure 9:
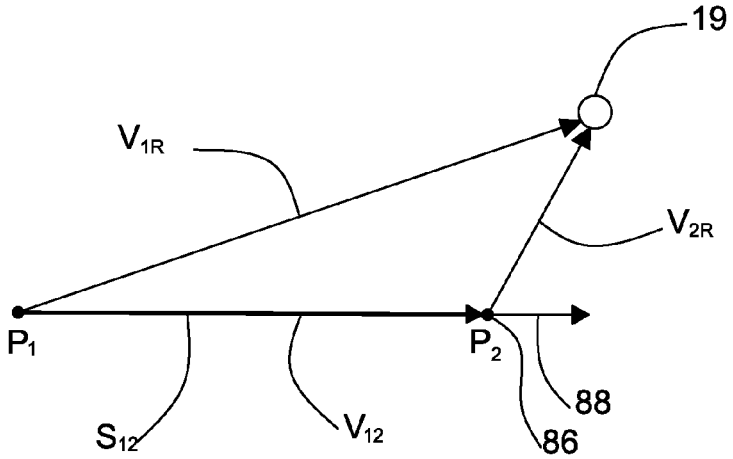
FIG. 9 is a diagrammatic illustration of still another portion of the path of travel relative to the reference point.

If the dot product is positive and greater than the length of the vector $V_{12}$, the projection 88 of vector $V_{1R}$ onto the vector $V_{12}$ intersects with a line through the vector $V_{12}$ but after the second point $P_2$ as depicted in FIG. 9. As a result, the closest or near point 86 along segment $S_{12}$ to reference point 19 is second point $P_2$ and the shortest path from segment $S_{12}$ extends from point $P_2$ and is equal to vector $V_{2R}$.

Referring back to FIG. 7, if the dot product is positive and less than the length of vector $V_{12}$, the projection 88 of the vector $V_{1R}$ is onto the vector $V_{12}$ at a point 91 between first point $P_1$ and second point $P_2$. As a result, the closest or near point 86 along segment $S_{12}$ to reference point 19 is point 91 and the shortest path from segment $S_{12}$ is along the line that extends from segment $S_{12}$ at a right angle and towards reference point 19. The vector between the segment $S_{12}$ and the reference point 19 may be expressed as $V_{NR}$ and may be calculated by the following equation:

$$V_{NR}=V_{1R}(V_{1R}\cdot V_{12})V_{12}$$

where the "·" represents the dot product or scalar product function.

Referring to FIG. 5, the vectors between the near point 86 and the segments of the three scenarios of FIGS. 7-9 are depicted with respect to second segment $S_{23}$, third segment $S_{34}$, and first segment $S_{12}$, respectively. That is, the shortest distance from each of the first segment $S_{12}$, second segment $S_{23}$, and third segment $S_{34}$ to the reference point 19 is depicted by a vector identical to those vectors depicted in FIGS. 7-9. Once the shortest distance between each segment on three dimensional path 85 and the reference point 19 has been determined, the distances are compared and the closest point from the reference point to the three dimensional path 85 or near point 86 is identified. In the example depicted in FIG. 5, segment $S_{23}$ is the closest to reference point 19 and the closest or near point 86 is at point 91.

Figure 6:
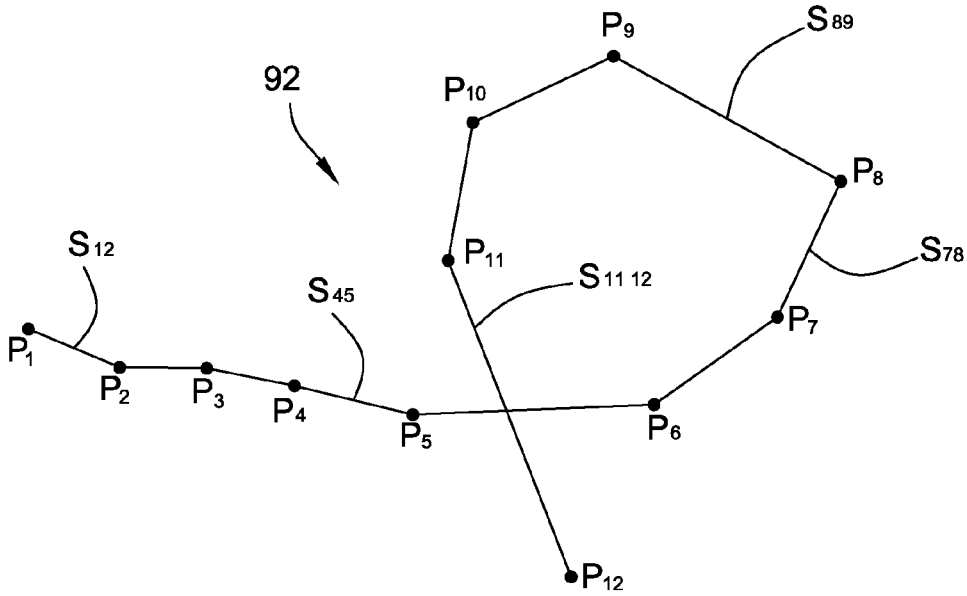
FIG. 6 is a diagrammatic illustration of an alternate embodiment of a portion of a path of travel of a reference point of the component along a three dimensional path.

To save computational time, the controller 36 may be configured to store the near point 86 from the previous control loop and only search segments starting at that location and moving forward along the three dimensional path 85 for a predetermined distance. This may not only reduce computation time by preventing the controller 36 from searching every segment along the three dimensional path 85, but also reduce errors if the path has been generated with a configuration that loops back or is otherwise configured so that segments cross over each other as depicted in the alternate path 92 of FIG. 6.

Once the near point 86 on the three dimensional path 85 is known, a target or look ahead point 89 may be determined at stage 64. The look ahead point 89 may be determined by starting at the near point 86 as determined at stage 63 and moving forward a predetermined distance along the path. The predetermined distance may be set within the controller 36 as a fixed distance or may vary along three dimensional path 85 as a variable distance. In either case, the controller 36 determines the look ahead point 89 along the three dimensional path 85. Adjusting the distance from the near point 86 to the look ahead point 89 may affect the continuity or "smoothness" of the path of travel of the reference point 19. In general, increasing the distance to the look ahead point 89 will increase the smoothness of the movement of the reference point 19 but may reduce the accuracy by which the work tool follows the three dimensional path 85. Similarly, decreasing the distance to the look ahead point 89 will generally increase the accuracy by which the reference point 19 follows the three dimensional path 85 but may reduce the smoothness of the movement.

Figure 10:
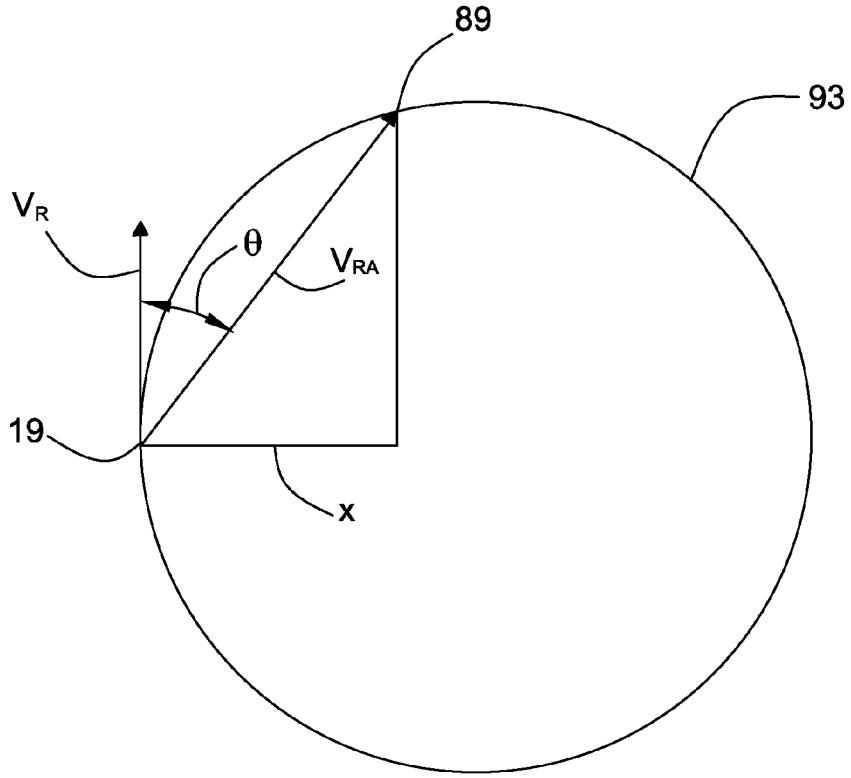
FIG. 10 is a diagrammatic illustration of certain vectors related to the reference point and a target point for the calculation of a desired directional vector of the reference point.

As shown in FIG. 10, once the look ahead point 89 is determined, a look ahead vector $V_{RA}$ may be generated at stage 65 extending generally from the position or at least proximate the position of the reference point 19 to the target or look ahead point 89. Using the velocity vector $V_R$ and the look ahead vector $V_{RA}$, a plane of travel of reference point 19 may be determined. Both the velocity vector $V_R$ and the look ahead vector $V_{RA}$ lie along the plane of travel and define a plane along which movement of the reference point is generally desired. As set forth in greater detail below, once the plane of travel is determined, the specific path or direction of travel within the plane of travel may be determined and then the speed of travel determined.

At decision stage 66, the controller 36 determines whether the velocity vector $V_R$ of the reference point 19 is non-zero. If the velocity vector $V_R$ is zero, the work tool 13 is not moving and thus the impact of the momentum of the implement system 12 and work tool 13 is reduced and the reference point 19 may be moved at stage 67 directly towards the look ahead point 89 (i.e., along the look ahead vector $V_{RA}$).

If the velocity of the reference point 19 is greater than zero at stage 66, it may not be desirable to move to reference point 19 directly towards the look ahead point due to the momentum of the implement system 12 and work tool 13. To determine the direction generally within the plane of travel that the reference point 19 should be moved, the controller determines at stage 68 the angle θ between the velocity vector $V_R$ and the look ahead vector $V_{RA}$. At stage 68, the angle θ between the vector $V_R$ and the vector $V_{RA}$ may be determined based upon the following equation:

$$\theta = a\cos\left(\frac{(V_R \cdot V_{RA})}{(|V_R||V_{RA}|)}\right)$$

If the absolute value of angle θ is greater than 90°, such angle θ may be limited to 90° while maintaining its positive or negative sign. So limiting angle θ will generally simplify the calculations involving angle θ and, as discussed below relative to stage 72, the speed of the reference point 19 may be significantly limited for any angle θ of 80° or larger so that limiting angle θ to 90° will not significantly impact the performance of the system or movement of reference point 19.

Figure 11:
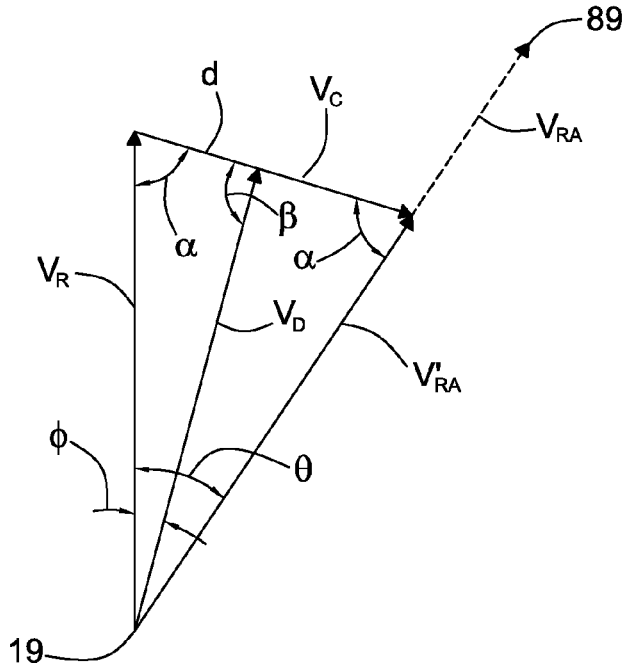
FIG. 11 is a diagrammatic illustration of a portion of FIG. 10 to illustrate the calculation of a desired directional vector of the reference point.

At stage 71, the direction of the desired movement (depicted as directional vector $V_D$ in FIG. 11) is determined. The directional vector $V_D$ may be calculated by the following equation:

$$V_D = \left(d\frac{V_C}{|V_C|}\right) + V_R$$

where $V_C$ is the connecting vector between velocity vector $V_R$ and scaled look ahead vector $V'_{RA}$ and d is the distance along connecting vector $V_C$ between velocity vector $V_R$ and directional vector $V_D$. If desired, the velocity vector $V_R$ that reflects the velocity of the reference point 19 and the look ahead vector $V_{RA}$ that extends from the reference point 19 to the look ahead point 89 may be redrawn as depicted in FIG. 11. In such Figure, the angle θ between the velocity vector $V_R$ and the look ahead vector $V_{RA}$ remains unchanged but the look ahead vector $V_{RA}$ is scaled so as to have the same length as velocity vector $V_R$ and is depicted as scaled look ahead vector $V'_{RA}$. Scaled look ahead vector $V'_{RA}$ is equal to the look ahead vector $V_{RA}$ times the ratio of the length of the velocity vector $V_R$ to the length of the look ahead vector $V_{RA}$ and may be expressed as follows:

$$V'_{RA} = V_{RA}\frac{|V_R|}{|V_{RA}|}$$

If desired, the velocity vector $V_R$ may be scaled so as to have the same length as the look ahead vector $V_{RA}$. Stated another way, the velocity vector and the look ahead vector may be scaled to define a scaled velocity vector and a scaled look ahead vector that have identical magnitudes. In any case, setting the two vectors so they have identical lengths may be desirable to simplify subsequent calculations.

As may be seen in FIG. 11, the directional vector $V_D$ is located between the velocity vector $V_R$ and the scaled look ahead vector $V'_{RA}$. An angle ϕ is the angle between the velocity vector $V_R$ and the directional vector $V_D$. The angle ϕ may be calculated by the following equation:

$$\phi=\omega/f$$

where the ω is the angular rate of the reference point 19 and f is the sample rate frequency of the system. The angular rate ω is equal to the curvature γ times the desired speed $s_d$ of the reference point 19. The sample rate frequency f is the inverse of the control loop time. The curvature γ of the path of circle 93 between reference point 19 and look ahead point 89 may be determined by the following equation:

$$\gamma = \frac{2\times}{|V_{RA}|^2}$$

From FIG. 10, it can be seen that an equation solving for x in terms of angle θ may be calculated as follows:

$$x=|V_{RA}|\sin(\theta)$$

Substituting one equation into the other results in:

$$\gamma = \frac{2\sin(\theta)}{|V_{RA}|}$$

Noting that the velocity vector $V_R$ and the scaled look ahead vector $V'_R$, are equal in length, the angles α opposite θ are equal. Accordingly, angle ∝ may be determined by the following equation:

$$\propto=(\pi-\theta)/2$$

The sum of angle ϕ, angle α and angle β must equal 180°. Therefore, the angle β may be expressed as a function of ϕ and angle α as follows:

$$\beta = \frac{\pi}{2} - \varphi + \frac{\theta}{2}$$

Through the use of angle β and angle ϕ as well as the length of velocity vector $V_R$ and the Law of Sines, the length d may be determined by the following formula $$d = \frac{|V_R|\sin(\varphi)}{\sin(\beta)}$$

Connecting vector $V_C$ may be expressed as follows:

$$V_C=V'_{RA}-V_R$$

Knowing the length d and the connecting vector $V_C$ as well as the velocity vector $V_R$ allows the calculation of directional vector $V_D$ by determining the vector along connecting vector $V_C$ having a length d and then adding that to the velocity vector $V_R$ as follows:

$$V_D = d\left(\frac{V_C}{|V_C|}\right) + V_R$$

During operation or during the set up process, an operator may designate a desired speed for each segment or series of segments along three dimensional path 85. At stage 72, the controller 36 may limit the desired speed based upon the value of angle θ. The angle θ reflects the difference between the direction that the reference point 19 is moving (i.e., along the velocity vector $V_R$) and the path directly to the target or look ahead point 89 (i.e., along the look ahead vector $V_{RA}$). Accordingly, the smaller the angle θ, the more aligned the current direction of movement of the reference point 19 is with the desired direction towards look ahead point 89. As angle θ increases, the controller 36 may be configured to slow the movement of the work tool 13 and thus reference point 19 because a command to move the work tool towards look ahead point 89 will require a substantial change in direction. Without a reduction in speed for a relatively large angle θ, the desired change in direction coupled with the momentum of the implement system 12 and work tool 13 may result in command signals from controller 36 that cannot be followed or possibly cause an abrupt movement of the work tool. In one example, with an angle θ equal to 60°, the full desired speed along three dimensional path 85 may be used without a reduction. An angle θ equal to 70° may result in a reduction in the desired speed of approximately 50 percent and an angle θ equal to 80° may result in a reduction in desired speed by approximately 90 percent. In other words, the controller 36 may reduce the speed of reference point 19 if the angle θ exceeds a predetermined amount.

At stage 73, the directional velocity $V_D$ may also be limited based upon the speed of the reference point 19 or the magnitude of the velocity vector $V_R$. If the speed of reference point 19 is relatively slow (i.e., the magnitude of the velocity vector $V_R$ is relatively small), as discussed with respect to stage 67 in which the velocity vector $V_R$ was zero, the directional vector $V_D$ may be modified so as to direct the reference point 19 towards look ahead point 89 in a more direct manner due to the reduced impact of the momentum of the implement system 12 and work tool 13. For example, at stage 67, if the reference point velocity were zero, the command velocity $V_{CMD}$ would be directly towards the look ahead point 89. The controller 36 may be configured so that as the speed of the velocity vector $V_R$ increases, the direction of the command vector $V_{CMD}$ is relatively quickly redirected from being aligned with the look ahead vector $V_{RA}$ to being aligned with the directional vector $V_D$. In other words, once the speed of the reference point exceeds a predetermined speed, the command vector $V_{CMD}$ is aligned with the directional vector $V_D$. In one example, the command vector $V_{CMD}$ may be aligned with the look ahead vector $V_{RA}$ when the speed of the velocity vector $V_R$ is relatively slow (e.g., <0.1 meters/second). The command vector may be redirected towards the directional vector $V_D$ relatively quickly as the speed of the velocity vector $V_R$ increases. In such example, the command vector $V_{CMD}$ may be aligned with the directional vector $V_D$ when the speed of the velocity vector $V_R$ is greater than 0.2 meters/second. The transition between alignment with the look ahead vector $V_{RA}$ (at <0.1 meters/second) and aligned with the directional vector $V_D$ (at 0.2 meters/second) may be linear between the two examples, if desired.

At stage 74, the command vector $V_{CMD}$ may be generated by multiplying the desired speed $s_d$ times a unit vector of the directional vector $V_D$ as follows:

$$V_{CMD} = s_d\left(\frac{V_D}{|V_D|}\right)$$

Once the command vector $V_{CMD}$ has been generated, the controller 36 may use inverse kinematic equations to determine the desired positions for the various hydraulic cylinders at stage 75. Based upon the current positions of the hydraulic cylinders and the desired positions determined at stage 75, the controller 36 at decision stage 76 determines whether the generated command signals will cause any of the hydraulic cylinders to move in a manner beyond their operating parameters. For example, the controller 36 may determine whether any of the hydraulic cylinders have been directed to move at a rate faster than a predetermined maximum rate or any of the cylinders will reach their end of travel positions. If the command signals generated would cause any of the hydraulic cylinders to move faster than a predetermined maximum rate, the controller 36 may reduce the speed or de-rate the commands to each of the hydraulic cylinders at stage 77. The modified command signals are then transmitted at stage 81 to the control system for controlling operation of the hydraulic cylinders. If the hydraulic cylinders will remain within their operating parameters based upon the command signals generated at stage 75, the controller will transmit those command signals to the control system at stage 81 to control the hydraulic cylinders.

Referring back to FIG. 3, after the command signals have been transmitted at stage 81, the controller determines at decision stage 82 whether the reference point 19 has reached the end of three dimensional path 85. If the end of the three dimensional path 85 has not been reached, the controller 36 repeats the process set forth in the flowchart of FIG. 3 beginning at decision stage 46. If the reference point 19 has reached the end of the three dimensional path 85 at decision stage 82, the machine 10 may be stopped at stage 83 and the operator notified that the operation has been completed.

INDUSTRIAL APPLICABILITY

The industrial applicability of the control system described herein will be readily appreciated from the foregoing discussion. The foregoing discussion is applicable to machines 10 that include an implement such as a work tool 13 that is moveable along a three dimensional path. In one example, the machine 10 may be an excavator including a hammer as a work tool. The machine 10 and the system disclosed herein may be used to break apart a structure such as a concrete sidewalk. The machine 10 may be positioned along the sidewalk at a first position and the hammer moved downward to break the concrete. After moving downward a predetermined distance, the hammer may be raised to a predetermined height and moved laterally to a second point along the path. The process may be completed with the hammer breaking up the concrete at predetermined positions along the path.

In another example, the work tool 13 may be a bucket and the machine 10 positioned to dig in a designated area and then dump each bucketful of material, at a predetermined location. Sensors may be provided so that the profile or three dimensional map of the area at which the machine 10 is digging may be updated during the digging operation. In one example, as the machine 10 is moving the bucket to a dump site, the sensors may sense the revised profile and create an updated map. The system may then generate a new desired path of travel indicative of the change of profile of the ground due to the digging operation. After the revised path of travel has been generated, the system may continue in an automated manner as disclosed herein.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for automated movement of a component along a three dimensional path, comprising:

a movable component having a reference point; and a controller configured to:

store a three dimensional path;

determine a velocity vector extending from a position at least proximate the reference point generally in a direction of movement of the reference point;

determine a look ahead vector extending from the position at least proximate the reference point generally towards a look ahead point, the look ahead point being located generally along the three dimensional path;

determine a plane of travel on which both the velocity vector and the look ahead vector lie;

determine a directional vector of the reference point along the plane of travel; and determine a command vector directing movement of the reference point at least in part based upon the directional vector.

2. The system for automated movement of claim 1, wherein the command vector is generally aligned with the look ahead vector if a speed of the reference point is zero.

3. The system for automated movement of claim 2, wherein the command vector is generally aligned with the directional vector if a speed of the reference point is greater than a predetermined speed, and the command vector is positioned between the directional vector and the look ahead vector if the speed of the reference point is greater than zero and less than the predetermined speed.

4. The system for automated movement of claim 1, wherein the command vector is generally aligned with the directional vector if a speed of the reference point is greater than a predetermined speed.

5. The system for automated movement of claim 1, wherein the controller is further configured to determine a near point on the three dimensional path located closest to the reference point and set the look ahead point a predetermined distance from the near point.

6. The system for automated movement of claim 5, wherein the predetermined distance is a variable distance.

7. The system for automated movement of claim 5, wherein the controller is further configured to de-rate commands to each hydraulic cylinder of the system if any hydraulic cylinder has been directed to move at a rate faster than a predetermined maximum rate.

8. The system for automated movement of claim 1, wherein the controller is further configured to determine an angle between the velocity vector and the look ahead vector and reduce a desired speed of the reference point if the angle exceeds a predetermined amount.

9. A system for automated movement of a component along a three dimensional path, comprising:

a movable component having a reference point; and a controller configured to:

store a three dimensional path;

determine a plane of travel generally along which movement of the reference point is desired;

determine a velocity vector extending from a position at least proximate the reference point generally in a direction of movement of the reference point;

determine a look ahead vector extending from the position at least proximate the reference point generally towards a look ahead point, the look ahead point being located generally along the three dimensional path;

scale the velocity vector and the look ahead vector to define a scaled velocity vector and a scaled look ahead vector, the scaled velocity vector and the scaled look ahead vector having substantially identical magnitudes;

determine a directional vector of the reference point along the plane of travel based upon the scaled velocity vector and the scaled look ahead vector; and determine a command vector directing movement of the reference point at least in part based upon the directional vector.

10. The system for automated movement of claim 9, wherein the command vector is generally aligned with the look ahead vector if a speed of the reference point is zero, the command vector is generally aligned with the directional vector if a speed of the reference point is greater than a predetermined speed, and the command vector is positioned between the directional vector and the look ahead vector if the speed of the reference point is greater than zero and less than the predetermined speed.

11. The system for automated movement of claim 9, wherein the controller is further configured to determine a near point on the three dimensional path located closest to the reference point and set the look ahead point a predetermined distance from the near point.

12. The system for automated movement of claim 11, wherein the predetermined distance is a fixed distance.

13. The system for automated movement of claim 11, wherein the predetermined distance is a variable distance.

14. The system for automated movement of claim 9, wherein the controller is further configured to determine an angle between the velocity vector and the look ahead vector and reduce a desired speed of the reference point if the angle exceeds a predetermined amount.

15. A method of moving a component along a three dimensional path in an automated manner, comprising:

providing a movable component having a reference point, storing a three dimensional path;

determining a velocity vector extending generally from a position at least proximate the reference point generally in a direction of movement of the reference point;

determining a look ahead vector extending generally from the position at least proximate the reference point towards a look ahead point, the look ahead point being located generally along the three dimensional path;

determining a plane of travel on which both the velocity vector and the look ahead vector lie;

determining a directional vector of the reference point along the plane of travel; and determining a command vector directing movement of the reference point at least in part based upon the directional vector.

16. The method according to claim 15, further including generally aligning the command vector with the look ahead vector if a speed of the reference point is zero, generally aligning the command vector with the directional vector if a speed of the reference point is greater than a predetermined speed, and positioning the command vector between the directional vector and the look ahead vector if the speed of the reference point is greater than zero and less than the predetermined speed.

17. The method according to claim 15, wherein the command vector is generally is generally aligned with the directional vector if a speed of the reference point is greater than a predetermined speed.

18. The method according to claim 15, further including determining a near point on the three dimensional path located closest to the reference point and setting the look ahead point a predetermined distance from the near point.

19. The method according to claim 18, further including setting the predetermined distance as a variable distance.

20. The method according to claim 15, further including determining an angle between the velocity vector and the look ahead vector and reducing a desired speed of the reference point if the angle exceeds a predetermined amount.

* * * * *